US011246362B2

(12) United States Patent
Darby

(10) Patent No.: US 11,246,362 B2
(45) Date of Patent: Feb. 15, 2022

(54) KNITTED BAND WITH INTEGRATED VENTILATION

(71) Applicant: NIKE, Inc., Beaverton, OR (US)

(72) Inventor: Christian Darby, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 122 days.

(21) Appl. No.: 16/220,620

(22) Filed: Dec. 14, 2018

(65) Prior Publication Data

US 2019/0119836 A1 Apr. 25, 2019

Related U.S. Application Data

(63) Continuation of application No. 14/095,457, filed on Dec. 3, 2013, now abandoned.

(51) Int. Cl.

| | |
|---|---|
| ***A41D 31/14*** | (2019.01) |
| ***D04B 1/24*** | (2006.01) |
| ***A41F 9/00*** | (2006.01) |
| ***D04B 1/18*** | (2006.01) |

(52) U.S. Cl.

CPC ..... *A41D 31/14* (2019.02); *A41F 9/00* (2013.01); *D04B 1/18* (2013.01); *D04B 1/243* (2013.01)

(58) Field of Classification Search

CPC ..... A41D 27/28; A41D 1/06; A41D 1/082; A41D 1/084; A41D 1/085; A41D 1/086; A41D 1/089; A41D 31/14; A41F 9/00; D04B 1/243

See application file for complete search history.

(56) References Cited

U.S. PATENT DOCUMENTS

| | | | | |
|---|---|---|---|---|
| 2,084,938 A | | 6/1937 | Busch et al. | |
| 2,301,541 A | | 11/1942 | Herb | |
| 2,351,199 A | * | 6/1944 | Fry | D04B 9/54 66/172 E |
| 3,711,868 A | * | 1/1973 | Kristof | A41F 9/00 2/237 |
| 3,887,968 A | * | 6/1975 | Lynam | D04D 9/04 24/712 |
| 3,956,906 A | * | 5/1976 | Cassidy, Sr. | D04B 1/104 66/42 R |
| 3,956,909 A | * | 5/1976 | Negri | D04B 1/243 66/177 |

(Continued)

FOREIGN PATENT DOCUMENTS

| | | | | |
|---|---|---|---|---|
| CN | 1882259 A | | 12/2006 | |
| GB | 475760 A | * | 11/1937 | D04B 1/26 |

(Continued)

OTHER PUBLICATIONS

Communication under Rule 71(3) dated May 9, 2019 in European Patent Application No. 18152516.3, 5 pages.

*Primary Examiner* — Megan E Lynch

(74) *Attorney, Agent, or Firm* — Shook, Hardy & Bacon L.L.P.

(57) ABSTRACT

Aspects of the present invention are directed toward a knitted band that may be incorporated into a garment that encircles or partially encircles one or more body regions of a wearer in an as-worn position. The knitted band has a plurality of functional zones that integrally knit together. One of the functional zones facilitates ventilation that helps cool the wearer.

20 Claims, 6 Drawing Sheets

(56) References Cited

U.S. PATENT DOCUMENTS 4,057,981 A 11/1977 Runac
4,244,199 A 1/1981 Rhode
4,523,337 A 6/1985 Leibowitz
4,631,932 A 12/1986 Sommers
4,682,479 A * 7/1987 Pernick ..... A41B 9/001 66/176
4,872,324 A 10/1989 Rearwin et al.
RE33,586 E * 5/1991 Graff ..... A41F 9/025 2/221
5,040,244 A 8/1991 Tubbs
5,125,246 A 6/1992 Shytles
5,297,296 A 3/1994 Moretz et al.
5,375,266 A 12/1994 Crisco
5,452,591 A 9/1995 King
5,465,594 A * 11/1995 Imboden ..... D04B 1/243 66/177
5,522,241 A * 6/1996 King ..... D04B 21/18 66/193
5,642,633 A 7/1997 Pedall
5,890,380 A 4/1999 Ives et al.
5,963,988 A 10/1999 Jackson, Jr.
6,041,441 A * 3/2000 Counts ..... A41D 1/08 2/227
6,079,236 A 6/2000 Ives et al.
6,516,637 B1 2/2003 Fancher et al.
6,546,564 B1 * 4/2003 Palmer ..... A41B 9/001 2/239
7,241,252 B1 * 7/2007 Gagliardi ..... A41B 9/001 2/2.5
7,395,557 B1 7/2008 Ledyard
7,481,079 B1 * 1/2009 Waldrop ..... D04B 1/18 66/170
7,546,751 B2 * 6/2009 Lutz ..... D04B 1/18 66/177
7,841,214 B2 11/2010 Park
7,882,713 B2 2/2011 Tseng
2002/0029407 A1 3/2002 Blechman
2002/0112510 A1 * 8/2002 Freedman ..... D04B 1/18 66/202
2002/0152775 A1 * 10/2002 Browder, Jr. ..... A41C 1/003 66/170
2003/0233698 A1 * 12/2003 Villalobos ..... A41D 1/06 2/227
2005/0095406 A1 * 5/2005 Gunzel ..... B29C 65/5092 428/190
2006/0207297 A1 9/2006 Tseng
2007/0022929 A1 * 2/2007 Wang ..... A41D 20/00 112/1
2008/0110049 A1 * 5/2008 Sokolowski ..... D04B 1/22 36/50.1
2009/0270012 A1 10/2009 Melarti et al.
2010/0242151 A1 9/2010 Mather
2012/0036615 A1 * 2/2012 Bradstreet ..... A41D 1/089 2/236
2012/0084903 A1 4/2012 Roberts et al.
2012/0122372 A1 5/2012 Fong
2012/0151658 A1 * 6/2012 Von Furstenberg ..... A41D 13/1236 2/114
2012/0178344 A1 7/2012 D'Anza
2013/0007947 A1 * 1/2013 Moore ..... A41F 9/02 2/236
2013/0239294 A1 * 9/2013 Clement ..... A41D 27/245 2/228
2014/0259304 A1 * 9/2014 Mitchell ..... A41C 3/0057 2/400
2014/0310854 A1 * 10/2014 Kianmahd ..... A41F 9/02 2/237
2014/0331385 A1 * 11/2014 Okies ..... A41D 1/06 2/235
2015/0020286 A1 * 1/2015 Wilson, II ..... A41F 9/025 2/69
2015/0082662 A1 * 3/2015 Farris ..... A43B 23/0205 36/84

FOREIGN PATENT DOCUMENTS

GB 475760 A 11/1937
WO 2005078178 A1 8/2005
WO WO-2005078178 A1 * 8/2005 ..... D04B 9/06
WO 2012029800 A1 3/2012

* cited by examiner

KNITTED BAND WITH INTEGRATED VENTILATION

CROSS-REFERENCE TO RELATED APPLICATIONS

This application having U.S. Non-Provisional patent application Ser. No. 16/220,620, filed on Dec. 14, 2018, and entitled "Knitted Band with Integrated Ventilation," is a Continuation of co-pending application Ser. No. 14/095,457, entitled "Knitted Band with Integrated Ventilation," and filed Dec. 3, 2013, the entirety of which is incorporated by reference herein.

STATEMENT REGARDING FEDERALLY SPONSORED RESEARCH OR DEVELOPMENT

Not applicable.

TECHNICAL FIELD

The present invention relates to a knitted band (e.g., a waistband) that can be incorporated into an article of clothing.

BACKGROUND

Sweat evaporation from a person's skin is an important cooling mechanism during exertion. Typically, in a given set of environmental conditions, a person will perspire at an increased rate with increasing exertion. Perspiration rate may be exacerbated by the fact that skin temperatures can become progressively warmer with tighter-fitting garments. Sweat-saturated garments are not only uncomfortable to the wearer but can adversely affect thermal regulation. Moisture management is the ability of a fabric to transport sweat away from the body in order to keep the wearer dry and comfortable. Elastic textiles are well-suited for incorporation into many active-wear garments because such textiles easily stretch to accommodate the movement of the wearer. Despite its benefits, some elastic textiles may have poor moisture management.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

Aspects of invention are directed toward a knitted band that is designed to increase air and moisture flow through the band. The increased air and moisture flow can help keep a person cooler and drier, especially during athletic activity. Integral ventilation zones within the knitted band facilitate the passage of air and moisture through the band. The ventilation zones are knit using a stitch and yarn or yarn combination that form small openings through which air and moisture pass with less resistance than in other zones. For example, thinner thread and a more open-stitched pattern may be used to form a ventilation zone. Other functional zones in the knitted band can include structural zones, attachment zones, and knit tunnel zones.

The knitted band may be incorporated into one or more garments at one or more locations. In some examples, the knitted band may be incorporated into pants, shorts, socks, shin guards, sport bras, shirts, undergarments, and the like. The knitted band may therefore be incorporated into a cuff, an arm portion, a leg portion, a torso portion, a chest band portion, a collar portion, a waist portion, an ankle portion, a sleeve portion, or any other portion of a garment that encircles or partially encircles the wearer.

In one aspect, the knitted band includes flared sections that help the knitted band conform to the wearer. The flare is formed by the bottom edge curving away from the top edge as the bottom edge extends from an anterior location towards a posterior location. Similarly, the flare may also be defined by the bottom edge extending away from the top edge in a substantially linear manner as the bottom edge extends from a posterior location toward an anterior location. The flare of the knitted band increases the band's surface area and thus the space available to add or increase the size of the ventilation zones, in an exemplary aspect.

In one aspect, one or more cables run through the knitted band. The cables may be thread through openings in the band. In another aspect, the cables run through knit tunnel zones integrally knit into the band between an inner and outer face of the band. The knit tunnel zones comprise open-ended elongated enclosures that resemble tunnels. The cables can provide structure to the knitted band and be used to adjust a tightness of the band. In one aspect, the cables attach to drawstrings that are used to tighten or loosen the cables.

BRIEF DESCRIPTION OF THE DRAWINGS

Examples are described in detail below with reference to the attached drawing figures, wherein.

DETAILED DESCRIPTION

Aspects of the invention are directed toward a knitted band that includes one or more ventilation zones to help keep the wearer cool, especially during exercise. In addition to cooling, the knitted structure of the band may also include functional zones that facilitate comfort. Comfort can be facilitated by providing an appropriate amount of elasticity and a comfortable texture, especially where the band is likely to contact the skin of the wearer.

The knitted band may be incorporated into one or more garments at one or more locations. In some examples, the knitted band may be incorporated into pants, shorts, socks, shin guards, sport bras, shirts, undergarments, and the like. The knitted band may therefore be incorporated into a cuff, an arm portion, a leg portion, a torso portion, a chest band portion, a collar portion, a waist portion, an ankle portion, a sleeve portion, or any other portion of a garment that encircles or partially encircles the wearer. As used herein, the phrase "encircles the wearer" means the knitted band encircles any part of the wearer including the wearer's waist, arm, head, neck, leg, wrist, and such.

Figure 1:
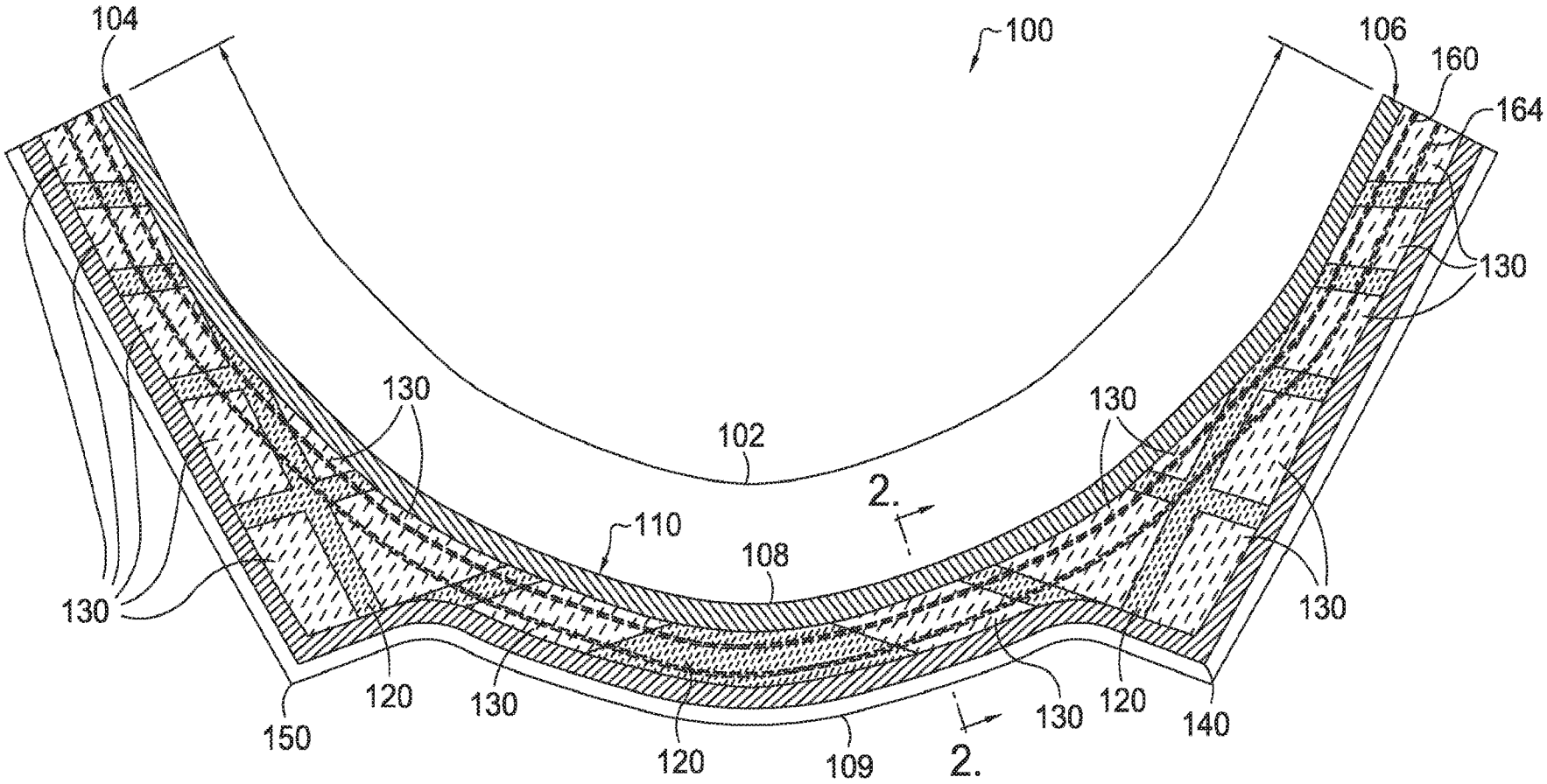
FIG. 1 depicts a front perspective view of a knitted band in accordance with an example of the present invention.

FIG. 1 illustrates a knitted band having multiple functional zones, in accordance with an aspect of the present invention. Various knitting techniques can be used to form the band including warp knitting, stitch-bonding, weft knitting, flat knitting, and any other suitable technique. Variations in yarns and knots employed within the different knitting techniques may be used to generate different functional zones. The band body 100 has an inner face (i.e., a surface that faces toward a wearer in an as-worn position) and an outer face (i.e., a surface that faces away from a wearer in an as-worn position). The band body 100 has a length 102 from a first end 104 to a second end 106. The body includes a top edge 108 and a bottom edge 109. The top edge 108 and the bottom edge 109 form the longitudinal sides of the band body 100 when the band body is in a lengthwise orientation. The top edge 108 may be located above (e.g., superior location) the bottom edge 109 in an as-worn position, for example when the knitted band is a waistband.

FIG. 1 illustrates four functional zones within a band body 100 of the knitted band. The structural zones are a single category of functional zones, but variation between structural zones is possible. Three different structural zones are illustrated in FIG. 1. The structural zones include an upper structural zone 110, medial structural zones 120, and a lower structural zone 140. The upper structural zone 110 is located along and forms the top edge 108 of the band body 100. The medial structural zones 120 run between the upper structural zone 110 and the lower structural zone 140. The lower structural zone 140 runs near the bottom edge 109.

In one aspect, the upper structural zone 110 has a first texture that is different from the lower structural zone's 140 second texture. The medial structural zones 120 may comprise a third texture different from the first and second texture. Different textures can be created by using different yarn or yarn combination and different stitches or combination of stitches to knit the fabric within a zone. The different yarns and stitches may be employed with different knitting techniques including warp knitting, weft knitting, flat knitting, and any other suitable technique. A yarn, as used herein is contemplated to include spun yarn (e.g., S-twist, Z-twist), filament yarns (e.g., monofilament, multiple filament, twisted, straight), texturized yarns, and the like. A yarn may also have any weight, texture, or finish. Further, a yarn may be formed from an organic and/or synthetic material suitable for forming a knit article.

The textures may be selected in keeping with the purpose of the zone. For example, the inner face of upper structural zone 110 can contact the skin of the wearer. Thus, a purpose of the upper structural zone is to provide comfort, which makes a smooth or supple texture (e.g., sometimes referred to as a soft hand) a good choice. For example, the upper structural zone 110 can comprise a 1×2 rib knit pattern texture.

In some aspects, the inner face of the lower structural zone 140 may be in contact with the wearer's undergarment (or any article of apparel), rather than the wearer's skin. Accordingly, the texture selected for the lower structural zone 140 need not be optimized for comfort. Instead, elasticity, breathability, durability, aesthetic appearance, stitchability, or other factors may govern a texture chosen for the zone. In one aspect, a ribbed-mesh pattern stitch texture is used in the lower structural zone 140.

The medial structural zones 120 extend between the upper structural zone 110 and the lower structural zone 140. The medial structural zones 120 may also be in contact with the wearer's undergarment, rather than the wearer's skin, in an exemplary aspect. However, it is also contemplated that the medial structural zones 120 may, in part, provide a skin contacting surface. For aspects where the inner surface at the medial structural zone 120 is not a skin-contacting surface, the texture selected for the lower structural zone 140 need not be optimized for comfort. Instead, elasticity, breathability, durability, aesthetic appearance, or other factors may govern a texture chosen for the zone. In one aspect, a medium-hole mesh stitch pattern texture is used in the medial structural zones 120. In one aspect, different medial structural zones 120 may have different textures.

A purpose of the medial structural zones 120 can be to provide elasticity. For example, the medial structural zones 120 may provide structure to the waistband that would not be provided by the ventilation zones; such that upon a deformation, the medial structural zones 120 help return the waistband to a pre-deformation state. In one aspect, the medial structural zones comprise greater elasticity than the ventilation zones.

The ventilation zones 130, which are a second functional zone, can be bounded by the various types of structural zones. The ventilation zones' functional purpose is to allow air and moisture to pass through the band body 100. The ventilation zones 130 may have a greater moisture vapor transmission rate ("MVTR") than other zones to facilitate vapor transmission. As used herein, the "moisture vapor transmission rate" is measured from the inner face (i.e., a surface that faces toward a wearer in an as-worn position) through the band body and out through the outer face (i.e., a surface that faces away from a wearer in an as-worn position). The MVTR can be defined by the rate at which water vapor passes through the band body in grams of water vapor per square meter of fabric per 24 hour period (g/m2/d), abbreviated herein to "g". In one aspect, the MVTR of the knitted fabric within the ventilation zones is 4,000 g or greater, for example, 5,000 g or greater, for example, 100,000,000,000 g or greater, or for example 10,000,000,000,000,000,000 g or greater. In one aspect, the vapor transmission rate is established using ASTM F2298—Standard Test Methods for Water Vapor Diffusion Resistance and Air Flow Resistance of Clothing Materials Using the Dynamic Moisture Permeation Cell. The actual MVTR can vary in as-worn conditions as the actual MVTR can be impacted by humidity difference between the interior and exterior of the band and other factors.

The desired MVTR can be produced through yarn selection, stitch selection, or a combination of both. Accordingly, in one aspect a yarn or combination of yarns and stitches is used to create a porous textile with a comparatively high MVTR. In one aspect, the ventilation zones 130 comprise a large-hole mesh knit pattern texture. The ventilation zones can have greater MVTR (i.e., moisture wicking functionality) than the structural zones or attachment zones. It is contemplated that a knit stitching pattern is implemented in this region to result in a more open pattern than in a structural zone. For example, a mesh-like knit stitch pattern may be implemented or other void-creating knit stitching patterns may be used in athletic shorts (e.g., basketball shorts, running shorts) when exterior water resistance is generally not important. A closed or non-porous stitch pattern may be used when water resistance (i.e., prevention of water moving from the exterior to the interior) is a design consideration. Otherwise much of the desired MVTR can be created using open stitches that produces a material with many and/or large pores through which air and vapor passes.

The yarn selection can also improve the MVTR. In one aspect, the ventilation zone is formed using, at least in part, hollow polyester fibers that wick perspiration from the skin to the garment surface positioned way from the skin where the perspiration can evaporate more quickly. In one aspect, the MVTR is mostly a function of the yarn selection. In other words, aspects of the invention include ventilation zones comprising few and/or small pores, but comprising yarns that produce a high MVTR though wicking. This may produce a fabric with high water resistance and a high MVTR. This combination may be desirable in outerwear used for hiking, camping, alpine skiing, and other applications were water resistance from the exterior is desirable in combination with a high MVTR.

The third functional zone is an attachment zone 150. The attachments zone 150 is used to join the band body 100 to an article of apparel. For example, the attachment zone 150 can be used as an attachment zone or coupling zone for the band body 100 to the attached or coupled with a waist portion of a pair of pants/shorts. For example, it is contemplated that the attachment zone 150 provides a location for the band body 100 to be stitched with a portion of an article of apparel. Aspects of the present invention are not limited to stitching the item of apparel to the attachment zone. Alternatively, glue or welding may be used to attach the attachment zone through an apparel item. The attachment zone can be optimized for one or more attachment methods. Accordingly, the yarn or yarns and stitch selection can be selected to produce a textile having the desired attachment characteristics.

Knit tunnel zones 160 and 164 are the fourth functional zones shown in FIG. 1. The knit tunnel zones are open-ended elongated enclosures between the inner face and the outer face of the band body 100. The tunnel zones are sized and shaped to receive tension cables that can be used to provide structure to the band and to adjust the band's fit to a body part. The tunnel zones can be created as part of the knitting process used to create the zone through which the tunnel zones 160 and 164 run. The tunnel zones 160 and 164 run continuously through the band body 100 of the knitted band in FIG. 1 from the first end 104 to the second end 106, in an exemplary aspect. In this arrangement, the tension cable is not visible, except at either end of the body (not depicted in FIG. 1), such as the first end 104 and the second end 106. In another aspect, the knit tunnel zones run intermittently through the band, for example with 1-inch gaps between tunnel openings. In this arrangement, the tension cable is intermittently visible across the exterior or interior surface of the knitted band.

The functional zones may be knit from one or more different yarns, including yarns that have elastic, comparatively high MVTR, stretchable, pliable and other qualities. The different zones may be created by using different knit stitching patterns and dropping different yarns in and out of the pattern, such as at a transition from one functional zone to a second functional zone. Dropping of a yarn may include changing from a first yarn type to a second yarn type, intentionally omitting a particular yarn from a portion of the knit stitching pattern, or terminating a first yarn at a portion of the knit stitching pattern. As such, it is contemplated that a transition from a first zone to a second zone may be accomplished by a transition in knit stitching pattern/technique and/or by dropping a yarn. The different combinations of yarns and knitting patterns generate different textiles to form different functional zones. As mentioned, the different functional zones may have different textures and different physical properties.

In one aspect, all of the functional zones within a knitted band are integrally knit during a single knitting event. As used herein, the phrase "integrally knit" means without seams. A seam connects two separately formed textile portions together using sewing stitches, glue, or some other connection method. In aspects, the different functional zones of the body are not separate textile portions, but are instead one continuous textile formed during a single knitting event. A transition from one knitting pattern or yarn combination to another does not constitute a seam.

A knitted band formed from the band body 100 may include a seam where the first end 104 is joined with the second end 106 to form the band. Further, the band body 100 may have a seam between the attachment zone 150 and an apparel item. Neither of these seams is within the band body 100 of the knitted band or between functional zones.

As used herein, the phrase "single knitting event" comprises all stitches made without removal of the band body 100 from a mechanical knitting apparatus. A transition from one knitting pattern or yarn combination to another does not constitute a separate knitting event.

Figure 2:
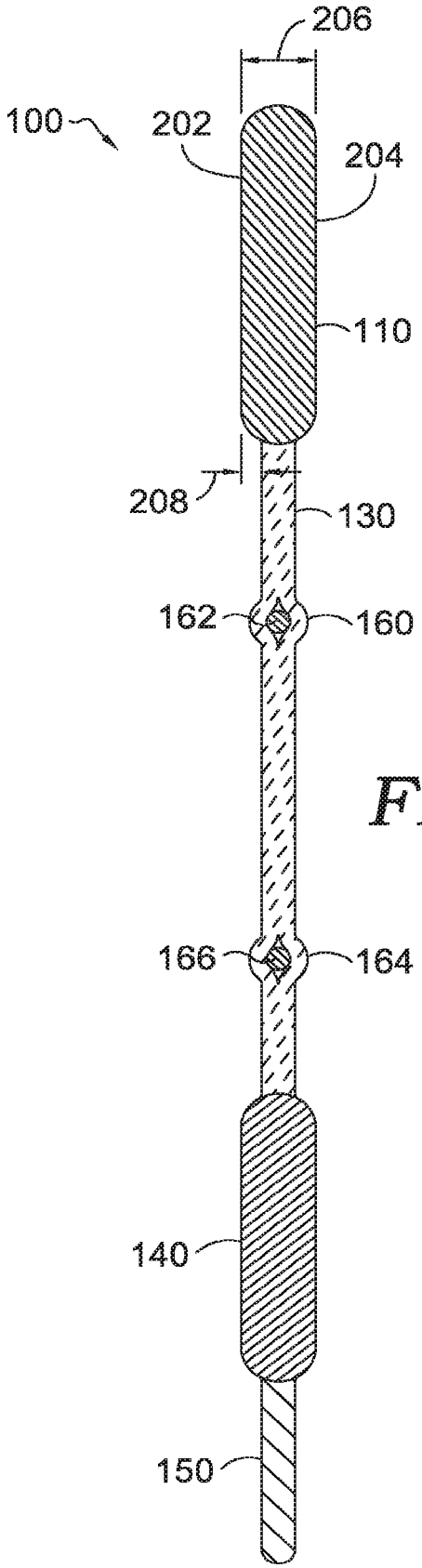
FIG. 2 depicts a cross section view of the knitted band of FIG. 1, in accordance with an aspect of the present invention.

Turning now to FIG. 2, a cross-section of band body 100 is shown, in accordance with an aspect of the present invention. The cross-section shows upper structural zone 110, ventilation zones 130, lower structural zone 140, and attachment zone 150. FIG. 2 does not show a medial structural zone because of where the cross-section is taken. The different zones may have a different width. The width 206 is the distance between the inner face 202 and the outer face 204 of the band body 100. The width 206 is measured perpendicularly from the face of the body.

The different widths are a result of different stitch patterns and yarn or yarn combinations used to form the different functional zones. In one aspect, it is desirable to have a ventilation zone 130 having a width that is less than a width of the upper structural zone 110 and the lower structural zone 140. The diminished width of the ventilation zone 130 creates a gap 208 between the wearer and the ventilation zone. The gap 208 can help facilitate the band's breathability.

The knit tunnel zones 160 and 164 are illustrated running through the ventilation zone 130. Tension cable 162 is shown running through tunnel zone 160. Tension cable 166 is shown running through tunnel zone 164. The cross-sectional area of each tunnel zone is slightly larger than the cross-sectional area of the tension cable running through the zone. This holds the cables in place while allowing the cable to move relative to the interior of the knit tunnel zone.

In other parts of the band body 100, the tunnel zones 160 and 164 run through the medial structural zone 120. In an aspect, the tunnel is formed from the yarn or yarn combination used to form the adjacent zone. Thus, the yarn or yarn combination used to form a single knit tunnel zone can change as the tunnel runs through different functional zones.

Figure 3:
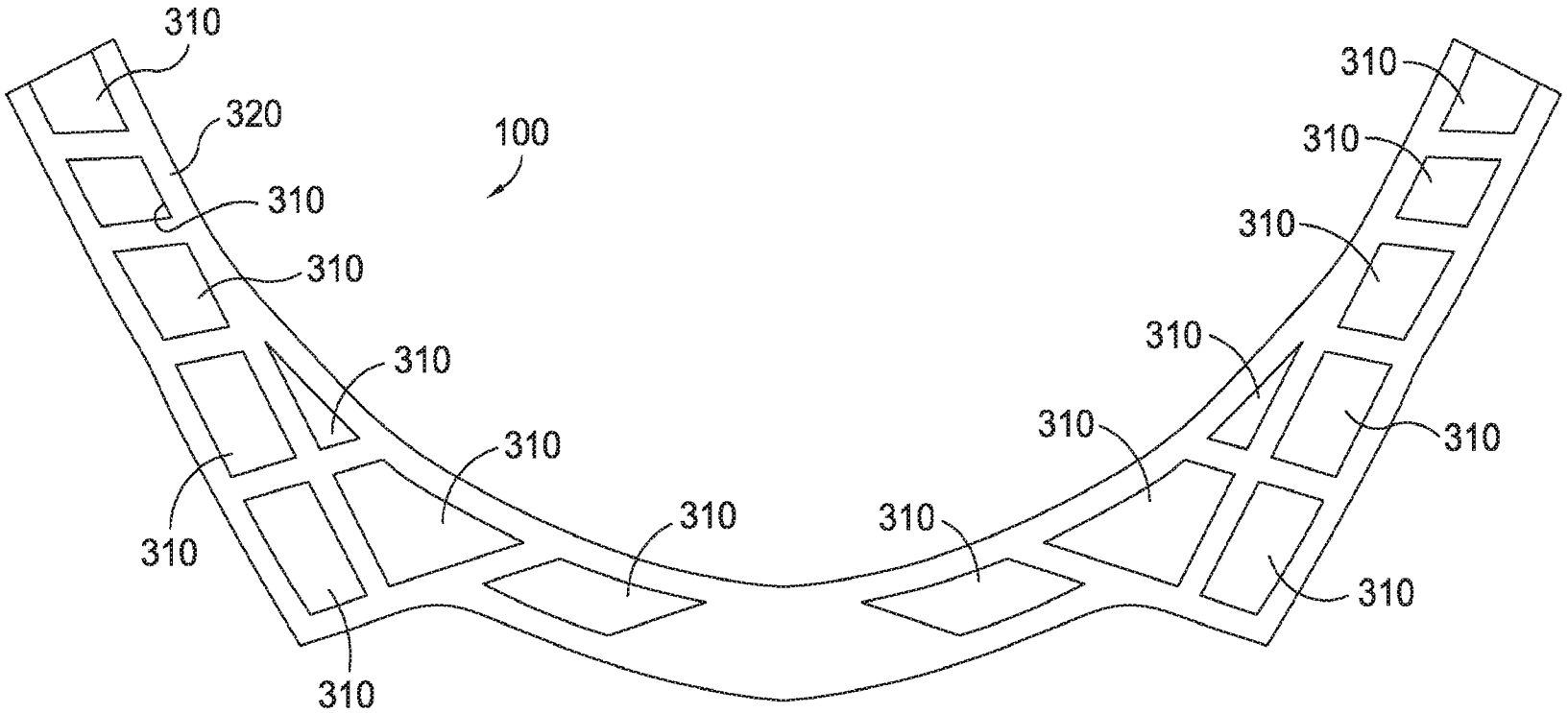
FIG. 3 depicts a ventilation zone pattern of the knitted band of FIG. 1, in accordance with an aspect of the present invention.

Turning now to FIG. 3, a ventilation pattern within the band body 100 is shown, in accordance with an aspect of the present invention. For the sake of simplicity and illustrating the pattern, the various structural zones (e.g., upper, medial, and lower) are shown as a single structural zone 320. The structural zone 320 defines the exterior of the various ventilation zones 310. As can be seen, the ventilation zones 310 can take the form of parallelograms, triangles, and other geometric shapes. In one aspect, the ventilation zones 310 can cover more than 50% of the band body's surface area, for example more than 60%, more than 70%, more than 80%, or 95% of the band body's surface area.

The band body 100 may be incorporated into a plurality of garments. Exemplary garments may be pants, shorts, socks, shin guards, sport bras, shirts, undergarments, and the like. The band body 100 may therefore be incorporated into a cuff, an arm portion, a leg portion, a torso portion, a chest band portion, a collar portion, a waist portion, an ankle portion, a sleeve portion, or any other portion of a garment that encircles or partially encircles a body region of the wearer. The band body 100 may be sewn, stitched or bonded at one or more seams to one or more textile panels that comprise a garment.

Figure 4:
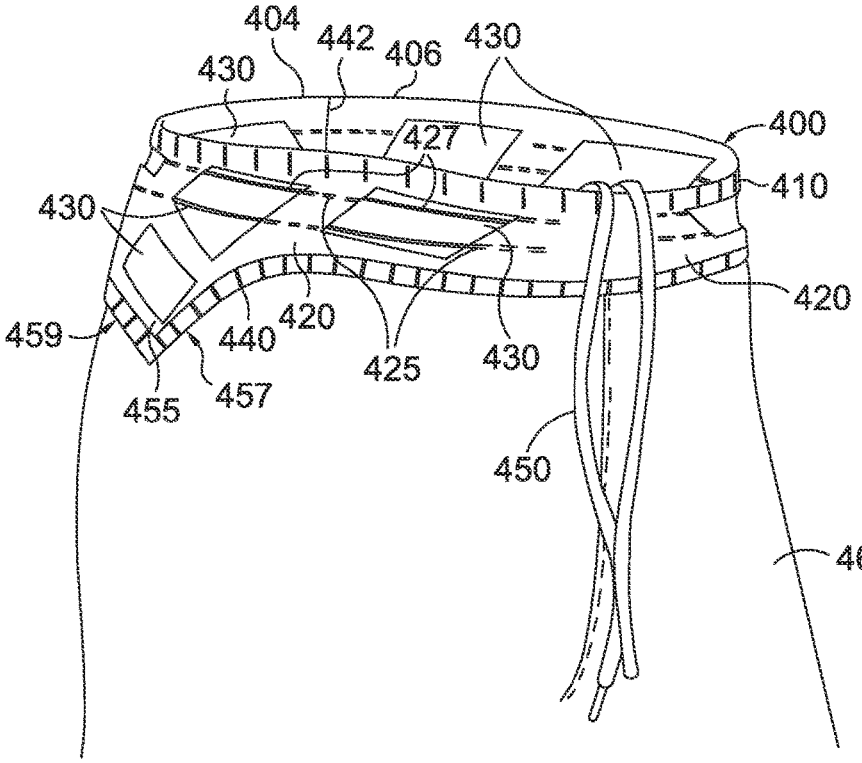
FIG. 4 depicts a knitted band with a back seam, tension cables, and a drawstring, attached to an apparel item, in accordance with an aspect of the present invention.

Turning now to FIG. 4, a knitted band 400 is shown attached to an apparel item 460. The apparel item 460 is designed to be worn over undergarments, in this example. For example, the apparel item 460 may be a pair of running shorts, basketball shorts, or the like. The knitted band 400 has a seam 442 joining end 404 and end 406 of the band body. The seam 442 is located at the back (i.e., posterior location) of the apparel item 460. The knitted band 400 comprises ventilation zones 430, along with an upper structural zone 410, medial structures zone 420, and lower structural zone 440.

The knitted band 400 comprises knit tunnel zones 425 that run through the medial structural zones 420, but not the ventilation zones 430. This arrangement of knit tunnel zones allows the tension cables 427 to be visible as they lay on the outer surface of the ventilation zones 430. In one aspect, the tension cables 427 are anchored (e.g., attached) near the seam 442 in the rear of the apparel item 460. In this arrangement, sets of tension cables 427 run in a semi-circle starting at the seam 442 and terminating at the drawstring 450. A wearer can then apply tension to the tension cables 427 by pulling on the drawstring 450. In an exemplary aspect, it is contemplated that the cable 427 is also the drawstring 450. Further, it is contemplated that the tension cables 427 have a first end extending from the seam 442 toward the drawstring 450 and then looping back to the same starting side of the seam 442 where it is fixedly coupled (e.g., anchored) with the band 400. It is contemplated that the loop formed proximate the drawstring 450 provides an interaction structure through which the drawstring 450 extends or is coupled to assist in the tensioning of the band 400 through a tying of the drawstring 450. It is contemplated that the knit tunnel zones are open ended at the time of the single knitting event such that the tensioning cables may be inserted without requiring a post process to allow the knit tunnels to be accessible, in an exemplary aspect.

A flared section 455 is arranged on the knitted band 400 to be adjacent to the wearer's hip. The flared section 455 may be defined as a portion of the knitted band 400 where a bottom edge comprises a curved portion 457 and a linear extending portion 459. The flared section 455 extends from an anterior location (e.g., proximate the drawstring 450) towards a posterior location (e.g., proximate the seam 442) curves in an inferior (e.g., downwardly) direction relative to a top edge. Put another way, the curved portion 457 is formed as the knit bottom edge curves in an inferior direction relative to the knit top edge as the knit bottom edge extends from a front portion of the knitted waistband 400 towards a side portion of the integrally knitted waistband when the knitted waistband 400 is in the as-worn configuration. The linearly extending portion 459 is formed as the knit bottom edge linearly extends in an inferior direction relative to the knit top edge as the knit bottom edge extends from a back portion of the integrally knitted waistband towards the side portion of the integrally knitted waistband when the integrally knitted waistband is. The curved portion 457 of the knit bottom edge meets the linearly extending portion 457 of the knit bottom edge to form the flared section 455 located at the side portion of the integrally knitted waistband when the integrally knitted waistband is in the as-worn configuration, and the flared section 455 extends inferiorly with respect to the curved portion 457 and the linearly extending portion 459. Further, the flared section 455 may be defined as the bottom edge extends from a posterior location towards an anterior location as linearly extending in an inferior direction from the top edge. It is this curved divergence on the anterior portion and the linear divergence in the posterior that provides, in an exemplary aspect, a knitted band that aligns with the underlying anatomy of a wearer to provide a functional (e.g., breathable and/or wicking properties) that maintains the connected article of apparel in an intended location. For example, when used as a waistband, the anterior curve adapts to the anterior (e.g., forward) articulation of the hip joint that causes a reduction of needed material and the linear posterior form of the flare 455 adapts to a material expansion caused by the extending/forward articulation of a user leg.

Figure 5:
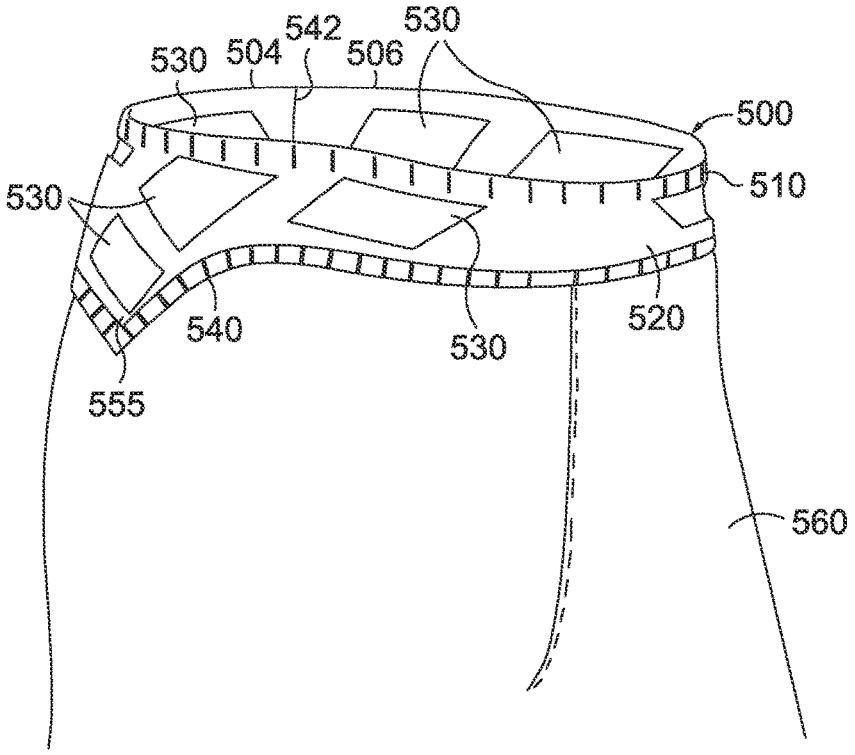
FIG. 5 depicts a knitted band with a back seam attached to an apparel item, in accordance with an aspect of the present invention.

Turning now to FIG. 5, a knitted band 500 is shown attached to the apparel item 560. The apparel item 560 may be worn against the skin of the wearer. For example, the apparel item 560 may be an athletic undergarment, yoga pants, compression shorts, bicycle shorts, or the like. The knitted band 500 has a seam 542 joining end 504 and end 506. The seam 542 is located at the back of the apparel item 560. The knitted band 500 comprises ventilation zones 530, along with an upper structural zone 510, medial structural zone 520, and lower structural zone 540. As can be seen, knitted band 500 does not include knit tunnel zones or tension cables. The flared section 555 is arranged on the knitted band 500 to be adjacent to the wearer's hip. In this example, it is contemplated that the tension provided by the band 500 alone is sufficient to maintain the apparel item 560 in a desired position. Because of this self-provided tension, it is contemplated that a tensioning cable and/or drawstring is not needed.

Figure 6:
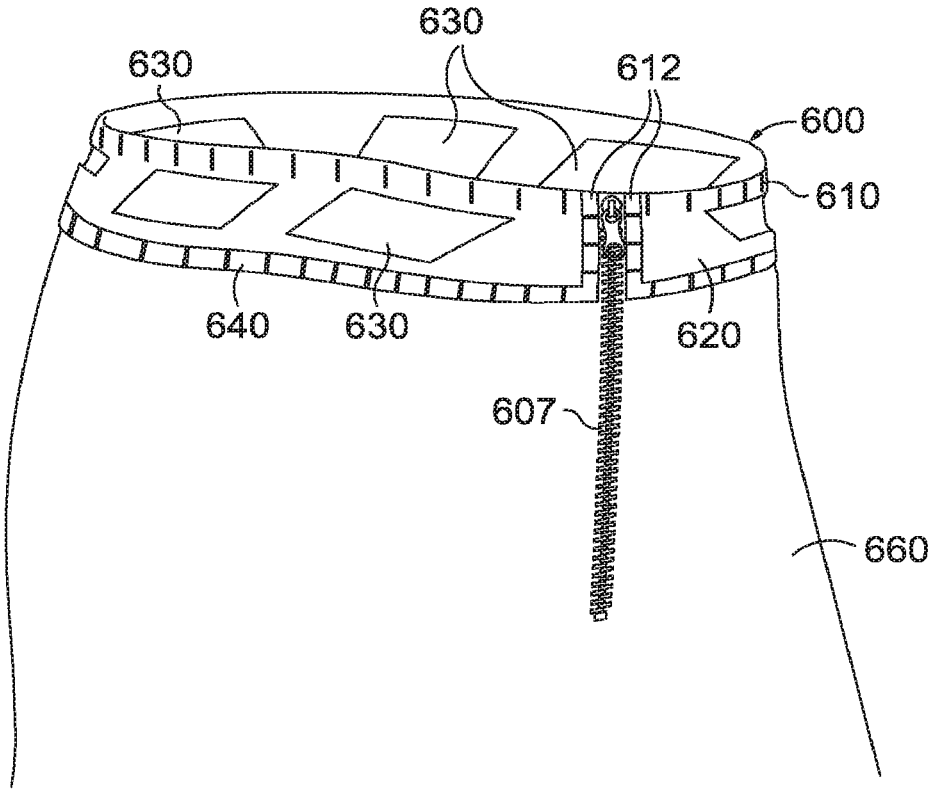
FIG. 6 depicts a knitted band with no seam attached to an apparel item, in accordance with an aspect of the present invention.

Turning now to FIG. 6, a knitted band 600 is shown attached to pants 660, such as a pant to be worn while golfing, in accordance with an aspect of the present invention. The knitted band 600 includes ventilation zones 630, upper structural zone 610, medial structural zone 620, and lower structural zone 640. The ends of the band 600 may meet at a front/anterior portion/location of the pants 660, such as at a zipper 607, as shown in FIG. 6. The knitted band 600 can include special structural zones 612 at either end of the band to provide additional support for the zipper. While the zipper 607 is shown exposed in FIG. 6, a flap could cover zipper in some aspects. While a specific arrangement of zones and dimensions are depicted, it is contemplated that any arrangement and dimensions may be implemented, in accordance with aspects hereof. Further, while a particular closure mechanism, the zipper 607, is depicted, it is contemplated that any closure mechanisms may be used, such as buttons, snaps, hook and loop, and the like.

The knitted band 600 does not include the flares present in other embodiments. This illustrates that the flare may be omitted in some aspects. Also, the knitted band 600 does not include a seam, instead being joined by the zipper 607.

Figure 7:
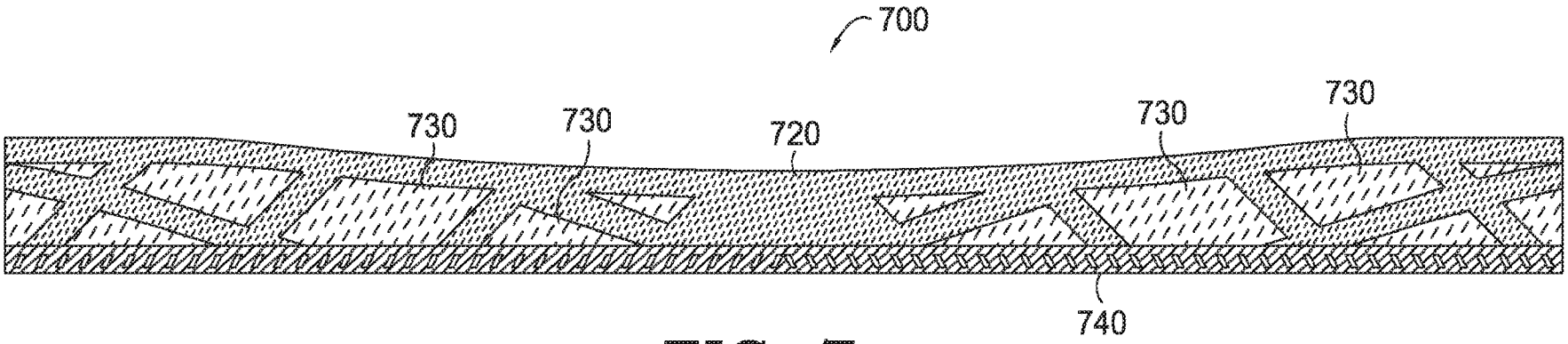
FIG. 7 depicts a front perspective view of an additional knitted band in accordance with an example of the present invention.

Turning now to FIG. 7, a knitted band 700 with a linear form factor that is different from those illustrated previously is shown, in accordance with an aspect of the present invention. Aspects of the invention may have different form factors depending on the application. For example, running shorts, which tend to be comparatively light, can use a thinner waste band (measured from top to bottom) than basketball shorts, which tend to be constructed from heavier material and more material. The overall curvature of the knitted band can also vary. Band 700 has less overall curvature than band 100 and is substantially linear, though the top edge and bottom edge are not exactly parallel. Also, as mentioned previously, a flared section does need to be included in some embodiments of the invention. Band 700 does not include a flared section.

For the sake of simplicity, the upper and medial structural zones illustrated above are shown as a single main structural zone 720. The band body 700 also comprises lower structural zone 740 that has different properties (e.g., elasticity, exterior surface texture) from the main structural zone 720. The combination of structural zones 720 and 740 defines the exterior of the various ventilation zones 730. As can be seen, the ventilation zones 730 can take the form of parallelograms, triangles, and other geometric shapes. In one aspect, the ventilation zones 730 can cover more than 50% of the band body's surface area, for example more than 60%, more than 70%, more than 80%, or 95% of the band body's surface area.

The band body 700 may be incorporated into a plurality of garments. Exemplary garments may be pants, shorts, socks, shin guards, sport bras, shirts, undergarments, and the like. The band body 700 may therefore be incorporated into a cuff, an arm portion, a leg portion, a torso portion, a chest band portion, a collar portion, a waist portion, an ankle portion, a sleeve portion, or any other portion of a garment that encircles or partially encircles a body region of the wearer. The band body 700 may be sewn, stitched or bonded at one or more seams to one or more textile panels that comprise a garment.

Aspects of the invention have been described to be illustrative rather than restrictive. It will be understood that certain features and subcombinations are of utility and may be employed without reference to other features and subcombinations. This is contemplated by and is within the scope of the claims.

What is claimed is:

1. An integrally knitted waistband comprising:

a body comprising an inner face and an opposite outer face, a knit top edge and a knit bottom edge opposite the knit top edge, and a portion extending between the knit top edge and the knit bottom edge, the body comprising a plurality of apertures, wherein:

the knit top edge is linear in an as-worn configuration, the knit bottom edge comprises:

a curved portion formed as the knit bottom edge curves in an inferior direction relative to the knit top edge as the knit bottom edge extends from a front portion of the integrally knitted waistband towards a side portion of the integrally knitted waistband when the integrally knitted waistband is in the as-worn configuration, and a linearly extending portion formed as the knit bottom edge linearly extends in an inferior direction relative to the knit top edge as the knit bottom edge extends from a back portion of the integrally knitted waistband towards the side portion of the integrally knitted waistband when the integrally knitted waistband is in the as-worn configuration, wherein the curved portion of the knit bottom edge meets the linearly extending portion of the knit bottom edge to form a flared section located at the side portion of the integrally knitted waistband when the integrally knitted waistband is in the as-worn configuration, and wherein the flared section extends inferiorly with respect to the curved portion and the linearly extending portion;

an upper structural zone located along and forming the knit top edge;

a lower structural zone located adjacent to the knit bottom edge;

a medial structural zone located between the upper structural zone and the lower structural zone; and a seam that joins a first end and a second end of the body to form the integrally knitted waistband.

2. The integrally knitted waistband of claim 1, further comprising:

a knit tunnel extending through at least part of the body in a direction parallel to the knit top edge, the knit tunnel defining an open-ended enclosure between the inner face and the outer face that is adapted to hold a tension cable within the body.

3. The integrally knitted waistband of claim 1, wherein the seam is located at one of the back portion or the front portion.

4. The integrally knitted waistband of claim 2, further comprising a drawstring attached to the tension cable.

5. The integrally knitted waistband of claim 4, wherein the tension cable extends in a semi-circle starting at the seam and terminating at the drawstring.

6. The integrally knitted waistband of claim 5, wherein the tension cable is anchored near the seam.

7. The integrally knitted waistband of claim 6, wherein the knit tunnel extends through the medial structural zone.

8. The integrally knitted waistband of claim 1, wherein the upper structural zone comprises a first knit stitch pattern.

9. The integrally knitted waistband of claim 8, wherein the first knit stitch pattern is a 1×2 rib knit pattern.

10. The integrally knitted waistband of claim 1, wherein the lower structural zone comprises a second knit stitch pattern.

11. The integrally knitted waistband of claim 10, wherein the second knit stitch pattern is a ribbed-mesh knit pattern.

12. The integrally knitted waistband of claim 1, wherein the medial structural zone comprises a mesh knit stitch pattern.

13. The integrally knitted waistband of claim 1, further comprising a plurality of ventilation zones located between the upper structural zone and the lower structural zone.

14. The integrally knitted waistband of claim 13, wherein the plurality of ventilation zones comprises a third knit stitch pattern.

15. The integrally knitted waistband of claim 14, wherein the plurality of ventilation zones are knit using a stitch, a yarn, or a combination of stitch and yarn that forms small openings through which air and moisture pass with less resistance than other areas of the integrally knitted waistband.

16. The integrally knitted waistband of claim 15, wherein the plurality of ventilation zones are comprised of a first yarn or a first yarn combination that produces a first fabric with a higher moisture vapor transmission rate than a second fabric produced by a second yarn or a second yarn combination.

17. The integrally knitted waistband of claim 16, wherein the plurality of ventilation zones are knit from the first yarn having different elastic properties from the second yarn used to knit one or more of the upper structural zone, the medial structural zone, and the lower structural zone.

18. The integrally knitted waistband of claim 17, wherein the second yarn used to knit the one or more of the upper structural zone, the medial structural zone, and the lower structural zone has greater elasticity than the first yarn used to knit the plurality of ventilation zones.

19. The integrally knitted waistband of claim 13, wherein the plurality of ventilation zones have a width less than a width of the upper structural zone and the lower structural zone.

20. The integrally knitted waistband of claim 1, wherein the upper structural zone comprises a first texture, the lower structural zone comprises a second texture, and the medial structural zone comprises a third texture, wherein the first texture is a different texture than the second texture, and wherein the third texture is a different texture from the first texture and the second texture.

* * * * *